US010479545B2

(12) United States Patent
Taruno et al.

(10) Patent No.: US 10,479,545 B2
(45) Date of Patent: Nov. 19, 2019

(54) DOUBLE CONTAINER

(71) Applicant: KYORAKU CO., LTD., Kyoto (JP)

(72) Inventors: Shinsuke Taruno, Kanagawa (JP); Tetsuaki Eguchi, Kanagawa (JP); Kentaro Uchihashi, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 15/577,086

(22) PCT Filed: May 27, 2016

(86) PCT No.: PCT/JP2016/065701
§ 371 (c)(1),
(2) Date: Nov. 27, 2017

(87) PCT Pub. No.: WO2016/190411
PCT Pub. Date: Dec. 1, 2016

(65) Prior Publication Data

US 2018/0178940 A1 Jun. 28, 2018

(30) Foreign Application Priority Data

May 28, 2015 (JP) ..... 2015-108399
May 28, 2015 (JP) ..... 2015-108844
Nov. 30, 2015 (JP) ..... 2015-234032

(51) Int. Cl.
*B65D 1/40* (2006.01)
*B65D 23/02* (2006.01)
*B65D 85/72* (2006.01)

(52) U.S. Cl.
CPC ..... *B65D 1/40* (2013.01); *B65D 23/02* (2013.01); *B65D 85/72* (2013.01)

(58) Field of Classification Search
CPC .... B65D 83/0055; B65D 1/32; B65D 1/0215; B65D 77/06
(Continued)

(56) References Cited

U.S. PATENT DOCUMENTS 6,341,718 B1 1/2002 Schilthuizen
7,867,434 B2 * 1/2011 Iwahashi ..... A61F 9/0008 264/40.1
(Continued)

FOREIGN PATENT DOCUMENTS

EP 1593605 A1 11/2005
JP S57-95422 A 6/1982
(Continued)

OTHER PUBLICATIONS

International Search Report dated Aug. 16, 2016 filed in PCT/JP2016/065701.
(Continued)

*Primary Examiner* — Shawn M Braden
(74) *Attorney, Agent, or Firm* — Rankin, Hill & Clark LLP

(57) ABSTRACT

Provided is a double container (1) configured so that water entrance through an atmospheric air introduction hole (15) can be reliably prevented and that an adverse effect due to water entrance into an intermediate space (21) between an outer shell (11) and an inner bag (12) can be avoided. The double container (1) has the outer shell (11) and the inner bag (12). The inner bag (12) contracts in association with a decrease in contents housed in the inner bag (12). The outer shell (11) is provided with the air introduction hole (15). Further, a hydrophobic filter configured to allow air penetration and block water is provided to close the air introduction hole (15).

6 Claims, 8 Drawing Sheets

(58) Field of Classification Search
USPC ..... 215/12.2
See application file for complete search history.

(56) References Cited

U.S. PATENT DOCUMENTS

| | | | | |
|---|---|---|---|---|
| 2003/0089735 | A1 | 5/2003 | Iwatsubo | |
| 2006/0054635 | A1 | 3/2006 | Iwahashi et al. | |
| 2013/0048125 | A1* | 2/2013 | Hoffman | F16K 15/144 137/852 |
| 2014/0052661 | A1* | 2/2014 | Shakes | G06Q 10/0836 705/339 |
| 2014/0190992 | A1* | 7/2014 | Kuwagaki | B65D 77/06 222/95 |
| 2014/0197207 | A1 | 7/2014 | Pozzi | |
| 2016/0052661 | A1 | 2/2016 | Abe | |
| 2016/0137390 | A1 | 5/2016 | Wochele | |
| 2016/0145015 | A1* | 5/2016 | Hoshino | B65D 83/0055 222/130 |

FOREIGN PATENT DOCUMENTS

| | | | |
|---|---|---|---|
| JP | 03133748 | | 6/1991 |
| JP | 04267727 | | 9/1992 |
| JP | 05124675 | | 5/1993 |
| JP | 2002-46761 | A | 2/2002 |
| JP | 200414196 | A | 5/2004 |
| JP | 2006335398 | A2 | 12/2006 |
| JP | 2007-326633 | A | 12/2007 |
| JP | 2013035557 | A2 | 2/2013 |
| JP | 2015-67291 | A | 4/2015 |
| WO | 0037179 | A1 | 6/2000 |
| WO | 2014157258 | A1 | 10/2014 |
| WO | 2014202278 | A1 | 12/2014 |

OTHER PUBLICATIONS

Extended European Search Report dated Nov. 7, 2018 for the corresponding European Patent Application No. 16800115.4.
Japanese Office Action (JPOA) dated May 15, 2019 issued in the corresponding Japanese patent application No. 2015-108844.

* cited by examiner

DOUBLE CONTAINER

TECHNICAL FIELD

The present invention relates to a double container, and specifically relates to the technique of preventing water entrance through an atmospheric air introduction hole.

BACKGROUND ART

Typically, a double container (a so-called delamination container) including a container main body and a check valve has been known (see, e.g., Patent Literatures 1 and 2). The container main body has an outer shell and an inner bag, and the inner bag contracts in association with a decrease in contents. The check valve is configured to adjust air outflow/inflow between an external space of the container main body and an intermediate space formed between the outer shell and the inner bag.

In the delamination container disclosed in Patent Literature 1, a valve is built in a cap attached to a port portion of the container main body. In the delamination container disclosed in Patent Literature 2, a valve is provided on the inside of a body portion of the outer shell.

CITATION LIST

Patent Literature

Patent Literature 1: JP-A-2013-35557
Patent Literature 2: JP-A-4-267727

SUMMARY OF INVENTION

Problems to be Solved by the Invention

In many cases, the delamination container is used as a food container. In many cases, the delamination container is filled with high-temperature contents, and then, shower cooling is performed for cooling the delamination container. Shower cooling is the method for spraying water from a shower to cool the container. In the case of employing such a cooling method, there is a high probability that the water adhering to the container is sucked through an atmospheric air introduction hole, and enters the intermediate space between the outer shell and the inner bag. Bacteria and the like might grow due to water entrance into the intermediate space, and for this reason, this case is not preferable considering food sanitation. Moreover, water entrance might provide an adverse effect on valve operation.

The present invention has been made in view of the above-described typical situation. An object of the present invention is to provide the following double container. Even in the case of performing shower cooling and the like for this double container, water entrance through an atmospheric air introduction hole can be reliably prevented, and an adverse effect due to water entrance into an intermediate space between an outer shell and an inner bag can be avoided.

Solutions to the Problems

In order to achieve the above-described object, a double container according to the present invention includes an outer shell and an inner bag. The inner bag contracts in association with a decrease in a content housed in the inner bag, the outer shell is provided with an air introduction hole, and a hydrophobic filter configured to allow air penetration and block water is provided to close the air introduction hole.

For example, the hydrophobic filter such as non-woven fabric made of polypropylene exhibits properties allowing air penetration while not allowing water penetration. Since the hydrophobic filter does not allow water penetration, no water enters an intermediate space between the outer shell and the inner bag through the atmospheric air introduction hole even when water adheres to the double container upon shower cooling and the like. Meanwhile, the hydrophobic filter allows air penetration, and therefore, cannot prevent air outflow/inflow through the atmospheric air introduction hole.

Effects of the Invention

According to the present invention, the following double container can be provided. Even in the case of performing shower cooling and the like for this double container, water entrance through the atmospheric air introduction hole can be reliably prevented, and an adverse effect due to water entrance into the intermediate space between the outer shell and the inner bag can be avoided.

DESCRIPTION OF EMBODIMENTS

An embodiment of a double container to which the present invention is applied will be described below. Features described below in the embodiment can be combined together.

Figure 1:
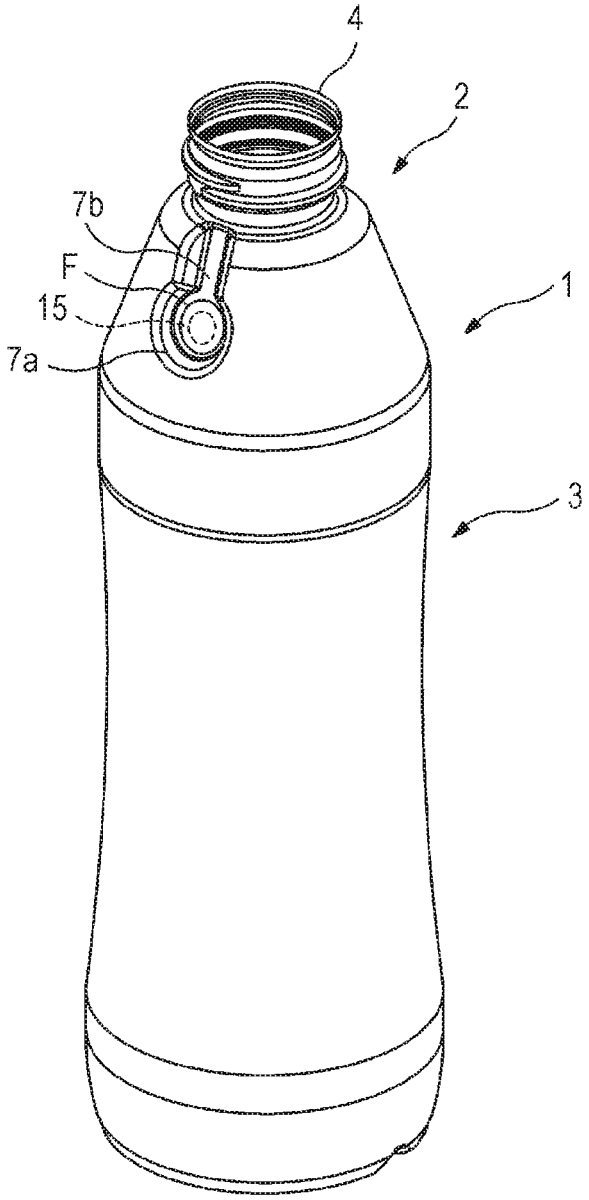
FIG. 1 is a perspective view of a structure of a double container of one embodiment of the present invention.
Figure 2:
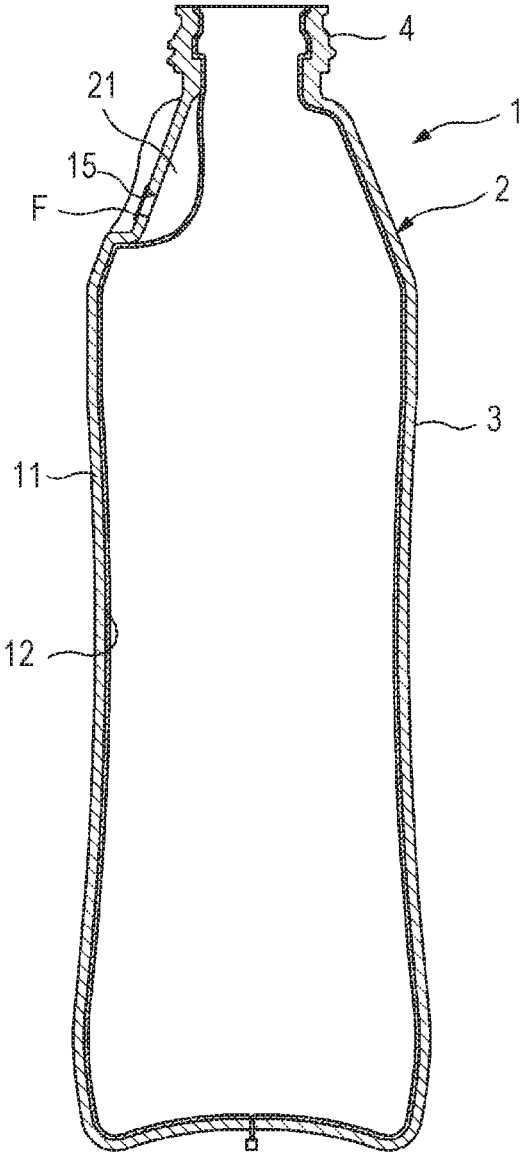
FIG. 2 is a schematic sectional view of the double container illustrated in FIG. 1.

As illustrated in FIG. 1, a double container 1 of one embodiment of the present invention is a so-called delamination container, and mainly includes a container main body 2. The container main body 2 includes a housing portion 3 configured to house contents, and a port portion 4 through which the contents are discharged from the housing portion 3. As illustrated in FIG. 2, the container main body 2 includes, at the housing portion 3 and the port portion 4, an outer layer 11 as an outer shell and an inner layer 12 as an inner bag. The inner layer 12 contracts in association with a content decrease.

The outer layer 11 and the inner layer 12 are supplied for blow molding as multilayer parison, and are molded with the outer layer 11 and the inner layer 12 being integrally joined together. In an example use form, the inner layer 12 is delaminated from the outer layer 11 in advance before use, and is filled with the contents until the inner layer 12 contacts the outer layer 11. The inner layer 12 smoothly contracts by extrusion of the contents. Alternatively, a state in which the inner layer 12 is joined to the outer layer 11 may be maintained, and the inner layer 12 may contract while being delaminated from the outer layer 11 in association with discharging of the contents.

A layer configuration of the container main body 2 will be further described. As described above, the container main body 2 includes the outer layer 11 and the inner layer 12. The outer layer 11 is formed thicker than the inner layer 12 to exhibit high stability.

Figure 3:
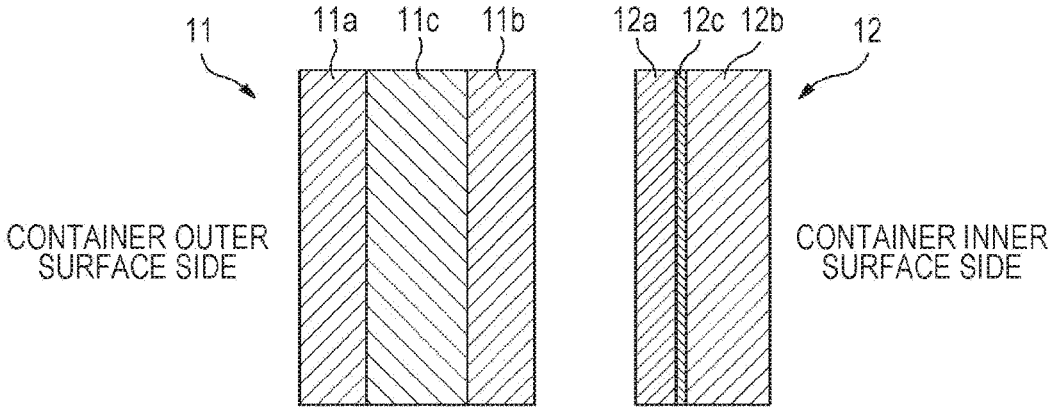
FIG. 3 is a sectional view of a layer configuration of outer and inner layers.

The outer layer 11 is, for example, made of low-density polyethylene, straight-chain very-low polyethylene, high-density polyethylene, polypropylene, ethylene-propylene copolymer, and a mixture thereof. The outer layer 11 has a single-layer or multilayer configuration, and a lubricant is preferably contained in at least one of the innermost layer or the outermost layer of the outer layer 11. In the case of the single-layer configuration of the outer layer 11, such a single layer is the innermost layer and the outermost layer, and therefore, may contain the lubricant. In the case of a double-layer configuration of the outer layer 11, a layer on a container inner surface side is the innermost layer, and a layer on a container outer surface side is the outermost layer. Thus, at least one of these layers may contain the lubricant. In a case where three or more layers form the outer layer 11, a layer on the container innermost surface side is the innermost layer, and a layer on the container outermost surface side is the outermost layer. As illustrated in FIG. 3, the outer layer 11 preferably includes a reproduction layer 11*c* between the innermost layer 11*b* and the outermost layer 11*a*. The reproduction layer indicates a recycled layer using burrs generated upon molding of the container. In the case of the multilayer configuration of the outer layer 11, the lubricant is preferably contained in both of the innermost layer and the outermost layer of the outer layer 11.

A general commercially-available lubricant can be used as the lubricant. The lubricant may be any of a hydrocarbon-based lubricant, a fatty acid-based lubricant, a fatty acid amide-based lubricant, and a metal soap-based lubricant, or may be a combination of two or more types of lubricants. The hydrocarbon-based lubricant includes, for example, liquid paraffin, paraffin wax, and synthetic polyethylene wax. The fatty acid-based lubricant includes, for example, stearic acid and stearyl alcohol. The fatty acid amide-based lubricant includes, for example, stearic acid amide, oleic amide, fatty acid amide of erucamide, and alkylene fatty acid amide of methylenebis stearic acid amide and ethylenebis stearic acid amide. The metal soap-based lubricant includes, for example, stearic acid metallic salt.

The innermost layer of the outer layer 11 is a layer contacting the inner layer 12. The lubricant is contained in the innermost layer of the outer layer 11, and therefore, delaminatability between the outer layer 11 and the inner layer 13 can be improved. On the other hand, the outermost layer of the outer layer 11 is a layer contacting a mold upon blow molding. The lubricant is contained in the outermost layer of the outer layer 11, and therefore, demolding properties can be improved.

One or both of the innermost and outermost layers of the outer layer 11 can be made of random copolymer between propylene and another type of monomer. Thus, shape stability, transparency, and heart resistance of the outer layer 11 as the outer shell can be improved.

In the random copolymer, the content of the monomer other than the propylene is less than 50 mol %, and preferably 5 to 35 mol %. Specifically, such a content is 5, 10, 15, 20, 25, or 30 mol %, for example. This content may fall within a range between any two of the numeric values described herein as examples. The monomer copolymerized with the propylene may be monomer for improving impact resistance of the random copolymer as compared to the case of homopolymer of polypropylene, and is particularly preferably ethylene. In the case of the random copolymer of the propylene and the ethylene, the content of the ethylene is preferably 5 to 30 mol %. Specifically, this content is 5, 10, 15, 20, 25, or 30 mol %, for example. This content may fall within a range between any two of the numeric values described herein as examples. The weight-average molecular weight of the random copolymer is preferably 100,000 to 500,000, and more preferably 100,000 to 300,000. Specifically, this weight-average molecular weight is 100,000, 150,000, 200,000, 250,000, 300,000, 350,000, 400,000, 450,000, or 500,000, for example. This content may fall within a range between any two of the numeric values described herein as examples.

Moreover, the tensile elastic modulus of the random copolymer is preferably 400 MPa to 1600 MPa, and more preferably 1000 MPa to 1600 MPa. This is because significantly-favorable shape stability is exhibited in a case where the tensile elastic modulus falls within such a range. Specifically, the tensile elastic modulus is 400 MPa, 500 MPa, 600 MPa, 700 MPa, 800 MPa, 900 MPa, 1000 MPa, 1100 MPa, 1200 MPa, 1300 MPa, 1400 MPa, 1500 MPa, or 1600 Mpa. The tensile elastic modulus may fall within a range between any two of the numeric values described herein as examples.

Note that when the container is extremely hard, usability of the container is degraded. For this reason, the outer layer 11 may be formed by mixing of a soft material such as straight-chain very-low polyethylene with the random copolymer, for example. Note that the material to be mixed with the random copolymer is preferably mixed, without greatly interfering with effective properties of the random copolymer, such that the material is less than 50 weight % with respect to the entire mixture. For example, the outer layer 11 can be formed of a material obtained in such a manner that the random copolymer and the straight-chain very-low polyethylene are mixed together at a weight ratio of 85:15.

The inner layer 12 includes an EVOH layer 13*a* provided on the container outer surface side, an inner surface layer 12*b* provided on the container inner surface side of the EVOH layer 12*a*, and an adhesion layer 12*c* provided between the EVOH layer 12*a* and the inner surface layer 12*b*. With the EVOH layer 12*a*, gas barrier properties and delaminatability from the outer layer 11 can be improved.

The EVOH layer 12*a* is a layer made of ethylene-vinylalcohol copolymer (EVOH) resin, and is obtained by hydrolysis of copolymer of ethylene and vinyl acetate. The ethylene content of the EVOH resin is 25 to 50 mol %, for example. Considering oxygen barrier properties, such a content is preferably equal to or less than 32 mol %. The lower limit of the ethylene content is not specified. Note that a smaller ethylene content results in lower flexibility of the EVOH layer 12*a*. For this reason, the lower limit of the ethylene content is preferably equal to or greater than 25 mol %. Moreover, the EVOH layer 12*a* preferably contains an oxygen absorber. Since the oxygen absorber is contained in the EVOH layer 12*a*, the oxygen barrier properties of the EVOH layer 12*a* can be further improved.

The melting point of the EVOH resin is preferably higher than that of the random copolymer forming the outer layer 11. An external air introduction hole 15 is preferably formed at the outer layer 11 by means of a thermal perforation device. The melting point of the EVOH resin is higher than that of the random copolymer, and this prevents the external air introduction hole 15 from reaching the inner layer 13 when such a hole is formed at the outer layer 11. Considering this point, a great difference of (Melting Point of EVOH)−(Melting Point of Random Copolymer) is preferable, more preferably equal to or higher than 15° C., and particularly preferably equal to or higher than 30° C. Such a melting point difference is 5 to 50° C., for example. Specifically, the difference is 5, 10, 15, 20, 25, 30, 35, 40, 45, or 50° C., for example. Such a melting point difference may fall within a range between any two of the numeric values described herein as examples.

The inner surface layer 12*b* is a layer contacting the contents of the double container 1. The inner surface layer 12*b* is, for example, made of polyolefin such as low-density polyethylene, straight-chain very-low polyethylene, high-density polyethylene, polypropylene, ethylene-propylene copolymer, and a mixture thereof. The inner surface layer 12*b* is preferably made of low-density polyethylene or straight-chain very-low polyethylene. The tensile elastic modulus of the resin forming the inner surface layer 12*b* is preferably 50 MPa to 300 MPa, and preferably 70 MPa to 200 MPa. This is because the inner surface layer 13*b* is especially soft in a case where the tensile elastic modulus falls within such a range. Specifically, the tensile elastic modulus is 50 MPa, 100 MPa, 150 MPa, 200 MPa, 250 MPa, or 300 Mpa, for example. The tensile elastic modulus may fall within a range between any two of the numeric values described herein as examples.

The adhesion layer 12*c* is a layer having the function of bonding the EVOH layer 12*a* and the inner surface layer 12*b*. For example, the adhesion layer 12*c* is the above-described polyolefin to which acid-modified polyolefin (e.g., maleic-anhydride-modified polyethylene) with an introduced carboxyl group is added, or is ethylene-vinyl acetate copolymer (EVA). An example pf the adhesion layer 12*c* is a mixture of acid-modified polyethylene and low-density polyethylene or straight-chain very-low polyethylene.

The layer configuration of the container main body 2 is as follows. In the container main body 2, an external thread portion is provided at the port portion 4, and a cap (a lid) with an internal thread is attached to the external thread portion (this configuration is not shown in the figure). Using a cap with an inner ring, an outer surface of the inner ring contacts a contact surface of the port portion 4, thereby preventing leakage of the contents.

At a shoulder portion of the housing portion 3, the outer layer 11 is provided with a recessed portion 7*a*. The atmospheric air introduction hole 15 is perforated at the recessed portion 7*a*. The atmospheric air introduction hole 15 is a through-hole provided only at the outer layer 11, and does not reach the inner layer 12. Air is introduced through the atmospheric air introduction hole 15 so that an intermediate space 21 is formed between the outer layer 11 as the outer shell and the inner layer 12 as the inner bag. That is, the intermediate space 21 and an external space S communicate with each other through the atmospheric air introduction hole 15.

Figure 4:
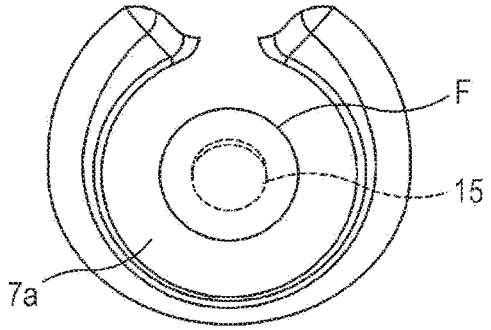
FIG. 4 is a schematic enlarged perspective view of a main portion of the vicinity of an atmospheric air introduction hole.
Figure 5:
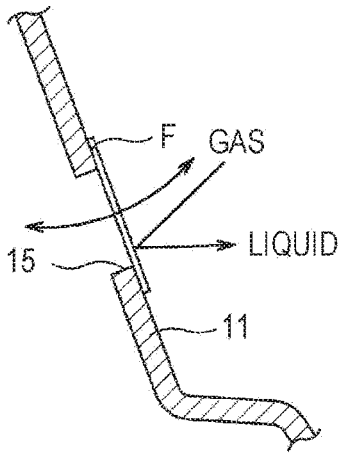
FIG. 5 is a schematic enlarged sectional view of the main portion of the vicinity of the atmospheric air introduction hole.

In the double container (the delamination container) of the present embodiment, a hydrophobic filter F is bonded to close the atmospheric air introduction hole 15 as illustrated in FIGS. 4 and 5. This prevents water from entering through the atmospheric air introduction hole 15.

The delamination container is a container intended for food products, for example. In many cases, shower cooling is employed for cooling after so-called hot packing. When shower cooling is performed after hot packing, the space between the outer layer 11 and the inner layer 12 is under a negative pressure, and therefore, water might be sucked through the atmospheric air introduction hole 15.

The hydrophobic filter F exhibits water-shedding properties. Since this film is bonded, water entrance through the atmospheric air introduction hole 15 can be prevented. For restoring the outer layer after squeeze discharging, air needs to be sent to the space between the outer layer 11 and the inner layer 12 through the atmospheric air introduction hole 15. For this reason, a filter allowing penetration of a large amount of air is preferably used as the hydrophobic filter F.

Examples of properties required for the hydrophobic filter F are as follows.

(1) Air penetration is allowed while water (liquid) penetration is not allowed.

(2) Less air permeability is preferably exhibited because a function similar to that of an atmospheric air introduction valve is necessary. Note that it is not suitable that air penetration is not allowed at all because no air enters the space between the outer layer 11 and the inner layer 12. Moreover, an air permeability balance needs to be taken into consideration.

(3) In the case of performing attachment by ultrasonic welding, a material suitable for ultrasonic welding is used (no fine powder is generated upon ultrasonic welding).

By means of the hydrophobic filter F satisfying these requirements, internal pressure maintenance upon squeezing and external air introduction upon restoration can be controlled.

Considering these points, the hydrophobic filter F is preferably non-woven fabric made of polypropylene, for example. The polypropylene non-woven fabric exhibits hydrophobic properties, and therefore, sheds water. In addition, the polypropylene non-woven fabric also exhibits favorable air permeability. Specifically, the polypropylene non-woven fabric preferably has a weight of 160 g/m$^2$ to 250 g/m$^2$ per unit area. This weight per unit area falls within such a range, and therefore, favorable air permeability can be ensured while water entrance can be reliably prevented.

Figure 6:
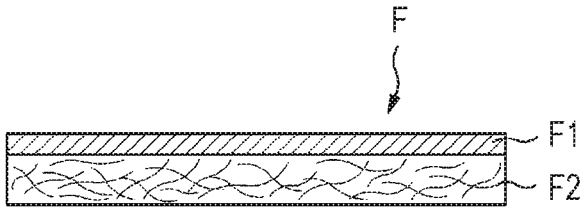
FIG. 6 is a schematic sectional view of one example of a hydrophobic filter.

Alternatively, a stack of hydrophobic microporous membrane and non-woven fabric can be used as the hydrophobic filter F. FIG. 6 illustrates an example of the hydrophobic filter F configured such that hydrophobic microporous membrane F1 and non-woven fabric F2 are stacked on each other. In the hydrophobic filter F with this double-layer structure, the hydrophobic microporous membrane F1 is a membrane provided with fine pores and made of, e.g., polyethylene terephthalate (PET) or polycarbonate. The hydrophobic microporous membrane F1 allows air penetration while not allowing water and liquid penetration. The fine pores formed at the microporous membrane F1 penetrate the membrane at various angles, and are each in a cylindrical shape. Moreover, the density of the fine pores is about $10^5$ to $10^9/cm^2$, and the diameter of each fine pore is about 0.1 μm to about 10 μm.

The fine pores are formed at the microporous membrane F1 as follows. A membrane made of, e.g., polyethylene terephthalate (PET) or polycarbonate is first ion-bombarded using heavy ions. Thereafter, the resultant is subjected to chemical etching. By ion bombardment, scratches are formed on a surface of the membrane. Starting from these scratches, fine pores are formed by chemical etching.

In the hydrophobic filter F illustrated in FIG. 6, the microporous membrane F1 is lined with the non-woven fabric F2, and therefore, the non-woven fabric F2 reinforces the microporous membrane F1. The material of the non-woven fabric F2 can be selected as necessary. For example, hydrophobic non-woven fabric made of polypropylene can be used.

A commercially-available filter can be used as the hydrophobic filter F configured such that the hydrophobic microporous membrane F1 and the hydrophobic non-woven fabric F2 are stacked on each other. Examples may include product names of M2657 and RoTrac manufactured by Oxyphen. Air permeability and thicknesses of representative examples (all made of polyethylene terephthalate) of the hydrophobic filter are as follows:

Product Name of M2657 manufactured by Oxyphen: >3.3 l/(min $cm^2$ bar), t=155±40 μm;

Product Name of R5587 manufactured by Oxyphen: >6.5 l/(min $cm^2$ bar), t=155±40 μm;

Product Name of M2810 manufactured by Oxyphen: 8±2.5 l/(min $cm^2$ bar), t=140±40 μm;

Product Name of M2803 manufactured by Oxyphen: 17.5±3.8 l/(min $cm^2$ bar), t=140±40 μm; and Product Name of M2802 manufactured by Oxyphen: 35±8 l/(min $cm^2$ bar), t=140±40 μm.

Needless to say, the hydrophobic filter F is not limited to above. As long as a filter sheds water and exhibits favorable air permeability, any filter can be used as the hydrophobic filter F.

The hydrophobic filter F may be attached to the double container portion provided with the atmospheric air introduction hole 15 by bonding or thermal welding. For example, in thermal welding, the outer layer 11 forming the double container might be melted. For this reason, it is difficult to employ thermal welding. In high-frequency welding, a metal film as a heat source is necessary. For this reason, it is also difficult to employ high-frequency welding for attachment of the hydrophobic filter F.

Considering these points, the hydrophobic filter F is preferably attached to the double container by ultrasonic welding. In ultrasonic welding, instant welding can be performed in such a manner that a horn contacts a back surface of the hydrophobic filter F to apply ultrasonic vibration and welding pressure.

Note that in ultrasonic welding as described above, uniform contact between the horn and a welding portion of the double container might be difficult because such a welding portion is soft and easily recessed. In this case, contact of the horn and ultrasonic welding can be smoothly performed in such a manner that the shape of the double container is retained by blowing of air into the double container and internal pressure application to the double container.

Figure 7:
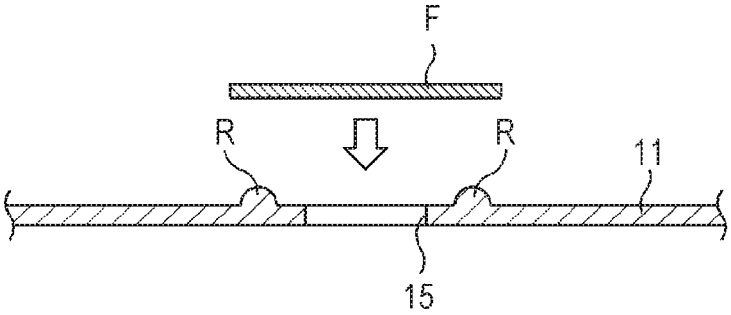
FIG. 7 is a schematic sectional view of a main portion of one example of a rib formed at an attachment portion of the hydrophobic filter.

Moreover, for ultrasonic welding, a rib is preferably formed at an attachment portion of the double container (the outer layer 11). FIG. 7 illustrates a state in which ultrasonic welding is performed for the hydrophobic filter F with a rib R being formed at the outer layer 11. For example, in a case where the circular hydrophobic filter F is attached, the rib R may be formed in a circular shape around the atmospheric air introduction hole 15, the circular shape having a slightly-smaller diameter than that of the hydrophobic filter F. The height of the rib R is preferably equal to or greater than 0.15 mm, and for example, is preferably about 0.25 mm. With the rib R, the rib R can function as an energy director to allow stable ultrasonic welding.

Further, in ultrasonic welding of the hydrophobic filter F, when the inner layer 12 contacts the outer layer 11, a hole might be formed at the inner layer 12 due to ultrasonic vibration. Thus, in ultrasonic welding, the inner layer 12 is preferably apart from the outer layer 11 in the vicinity of the attachment portion of the hydrophobic filter F.

In the case of attaching the hydrophobic filter F, the atmospheric air introduction hole 15 preferably has a diameter of 3 to 4 mm. An extremely-small diameter of the atmospheric air introduction hole 15 results in poor restoration of the outer layer 11. Conversely, an extremely-large diameter of the atmospheric air introduction hole 15 results in a higher difficulty in internal pressure application to the space between the outer layer 11 and the inner layer 12. This might lead to a discharging difficulty. Note that the diameter of the atmospheric air introduction hole 15 also relates to the air permeability of the hydrophobic filter F. Thus, the diameter of the atmospheric air introduction hole 15 is preferably set as necessary, considering the air permeability of the selected hydrophobic filter F.

The above-described hydrophobic filter F is preferably attached to close the atmospheric air introduction hole 15 even in a case where the atmospheric air introduction hole 15 is provided with a valve member. This is because the valve member is merely attached and water entrance easily occurs upon contact of the water.

Figure 8:
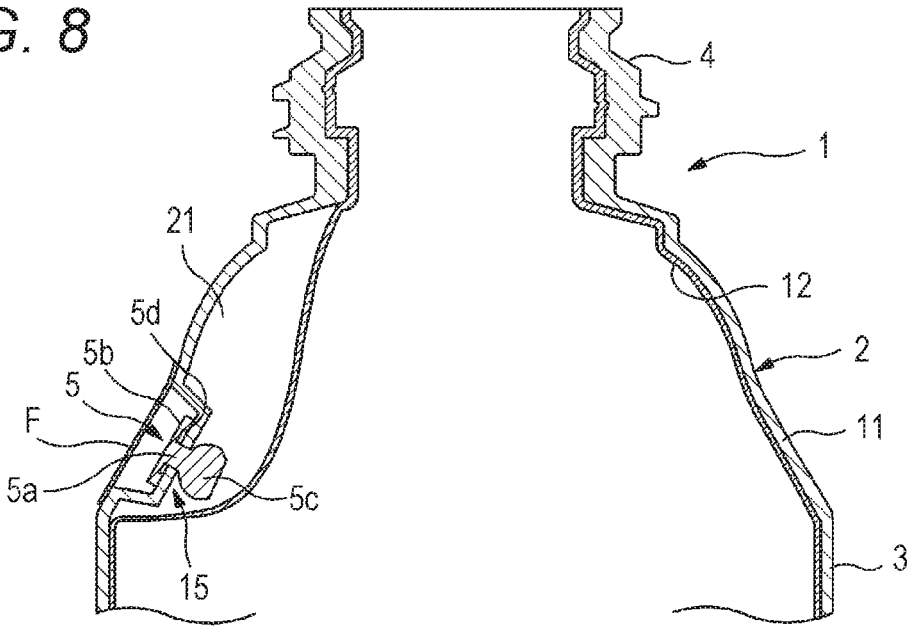
FIG. 8 illustrates one example of a double container having a valve member.

FIG. 8 illustrates one embodiment of the double container (the delamination container) having the valve member. The configuration of the container main body 2 is the same as that described in the previous embodiment. The atmospheric air introduction hole 15 provided with the valve member will be described herein.

In the present embodiment, the valve member 5 includes a shaft portion 5*a*, a lid portion 5*c*, and a lock portion 5*b*. The shaft portion 5*a* is inserted into the external air introduction hole 15, and is slidably movable relative to the external air introduction hole 15. The lid portion 5*c* is provided closer to the intermediate space 21 with respect to the shaft portion 5*a*, and has a larger sectional area than that of the shaft portion 5*a*. The lock portion 5*b* is provided closer to the external space S with respect to the shaft portion 5*a*, and prevents the valve member 5 from entering the intermediate space 21.

The lid portion 5*c* is configured to substantially close the external air introduction hole 15 when the outer layer 11 is compressed. The lid portion 5*c* has such a shape that the sectional area thereof decreases toward the shaft portion 5*a*. Moreover, the lock portion 5*b* is configured so that air can be introduced into the intermediate space 21 when the outer layer 11 is restored after having been compressed. When the outer layer 11 is compressed, the internal pressure of the intermediate space 21 reaches higher than an external pressure, and accordingly, air in the intermediate space 21 leaks to the outside through the external air introduction hole 15. Due to such a pressure difference and such an air flow, the lid portion 5*c* moves toward the external air introduction hole 15 to close the external air introduction hole 15. Since the lid portion 5*c* has such a shape that the sectional area thereof decreases toward the shaft portion 5*a*, the lid portion 5*c* is easily fitted in the external air introduction hole 15 to close the external air introduction hole 15.

When the outer layer 11 is further compressed in this state, the internal pressure of the intermediate space 21 increases. As a result, the inner layer 12 is compressed, and accordingly, the contents inside the inner layer 12 are discharged. When compression force on the outer layer 11 is released, restoration of the outer layer 11 tends to occur due to elasticity of the outer layer 11 itself. In this state, the lid portion 5*c* moves apart from the external air introduction hole 15, and the closure of the external air introduction hole 15 is released. Then, external air is introduced into the intermediate space 21. Moreover, for avoiding closing of the external air introduction hole 15 with the lock portion 5*b*, the lock portion 5*b* is provided with a protrusion 5*d* at a portion which is to contact the outer layer 11. By contact of the protrusion 5*d* with the outer layer 11, a clearance is provided between the outer layer 11 and the lock portion 5*b*. Note that instead of providing the protrusion 5*d*, a groove may be provided at the lock portion 5*b* to prevent the lock portion 5*b* from closing the external air introduction hole 15.

The valve member 5 can be attached to the container main body 2 in such a manner that the lid portion 5*c* is inserted into the intermediate space 21 while pushing and expanding the external air introduction hole 15. Thus, a tip end of the lid portion 5*c* preferably has a tapered shape. This valve member 5 can be attached only by pushing of the lid portion 5*c* into the intermediate space 21 from the outside of the container main body 2, leading to excellent productivity.

The housing portion 3 is covered with a shrink film after attachment of the valve member 5. In this state, the valve member 5 is attached to an attachment recessed portion 7*a* of the housing portion 3 not to contact the shrink film. For avoiding the shrink film from hermetically closing the attachment recessed portion 7*a*, an air circulation groove 7*b* extending from the attachment recessed portion 7*a* toward the port portion 4 is provided.

Figure 9:
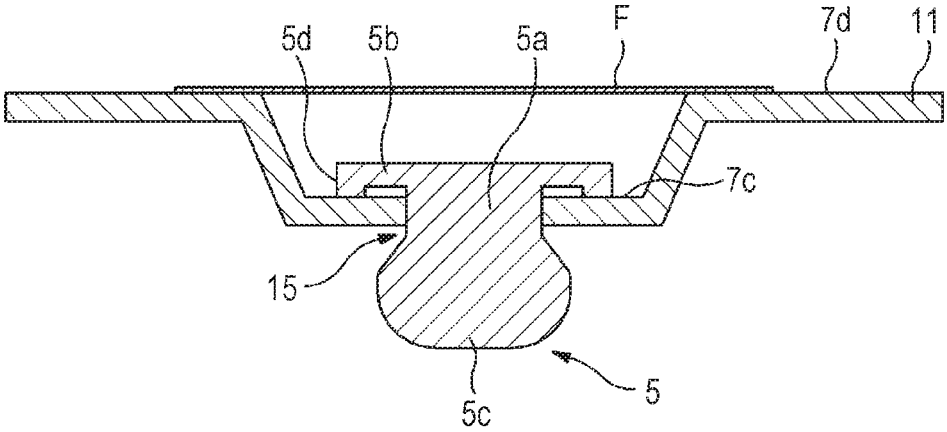
FIG. 9 is a sectional view of a main portion of an example where a hydrophobic filter is provided at an atmospheric air introduction hole provided with the valve member.

For example, in the case of attaching the valve member 5 as described above, the attachment recessed portion 7*a* is formed with a double structure as illustrated in FIG. 9. The valve member 5 is attached to a lower stage 7*c*, and the hydrophobic filter F is bonded to an upper stage 7*d*. This can reliably prevent water entrance through the atmospheric air introduction hole 15.

Next, the operation principle of the double container 1 having the check valve 5 upon use will be described.

Figure 10:
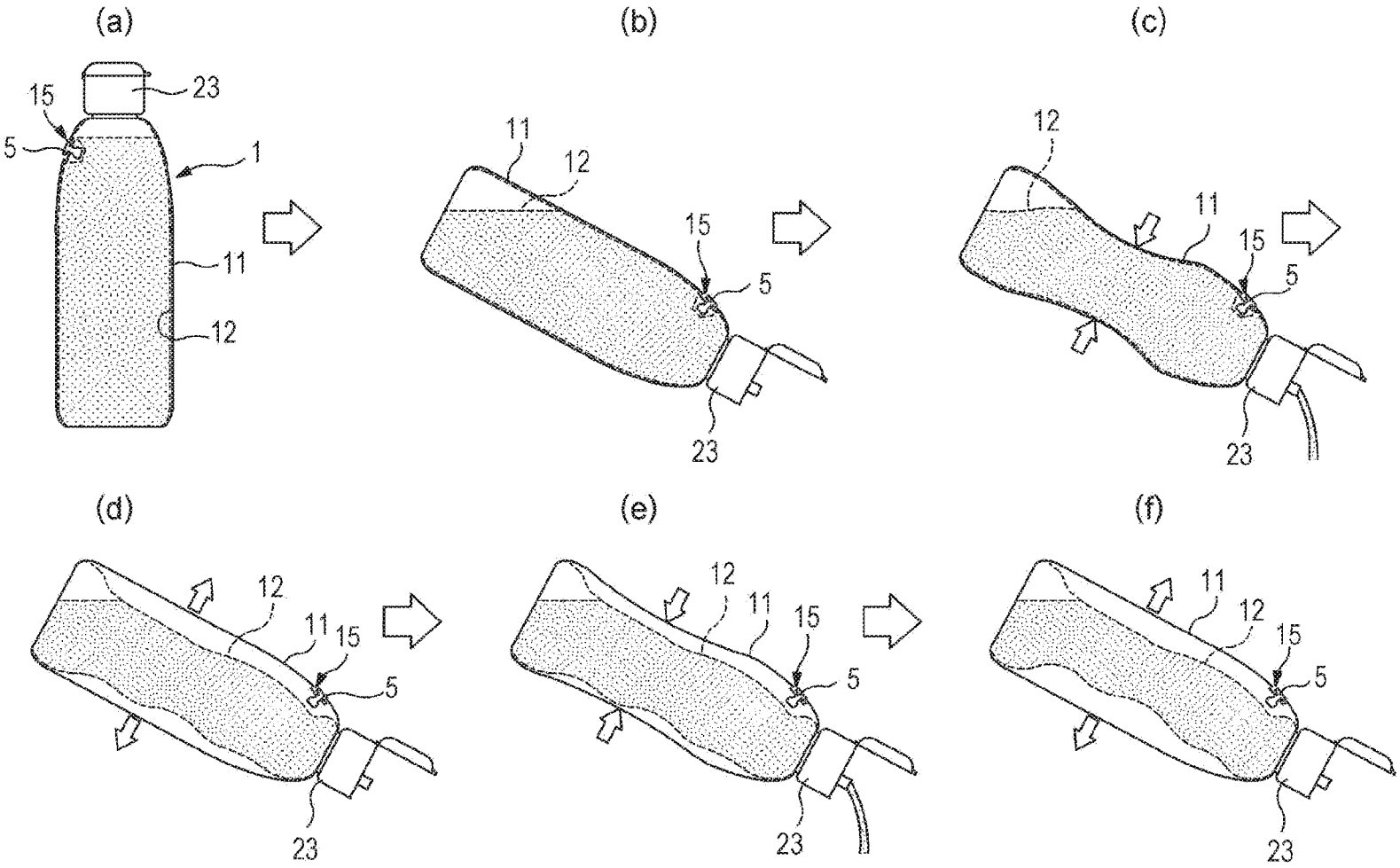
FIG. 10 is a view for illustrating the method for using the double container.

As illustrated in FIGS. 10(*a*) to 10(*c*), a side surface of the outer layer 11 is grasped in a state in which a product filled with the contents tilts, and then, the compressed contents are discharged. At the beginning of use, no clearance is substantially present between the inner layer 12 and the outer layer 11. Thus, the compression force applied to the outer layer 11 becomes the compression force of the inner layer 12 as it is, and the inner layer 12 is compressed to discharge the contents.

A not-shown check valve is built in a cap 23. Thus, the contents of the inner layer 12 can be discharged while external air cannot be taken into the inner layer 12. With this configuration, when the compression force applied to the outer layer 11 is eliminated after the contents have been discharged, the outer layer 11 tends to return to an original shape by restorative force of the outer layer 11 itself while the inner layer 12 remains contracted. Thus, only the layer 11 expands. Subsequently, as illustrated in FIG. 10(*d*), the inside of the intermediate space 21 between the inner layer 12 and the outer layer 11 is in a depressurized state, and therefore, external air is introduced into the intermediate space 21 through the external air introduction hole 15 formed at the outer layer 11. In a case where the intermediate space 21 is in the depressurized state, the valve member 5 is not pressed against the atmospheric air introduction hole 15, and therefore, external air introduction is not interfered.

Next, in a case where the side surface of the outer layer 11 is grasped and compressed again as illustrated in FIG. 10(*e*), the valve member 5 comes into contact with the atmospheric air introduction hole 15 to close the atmospheric air introduction hole 15, and therefore, the internal pressure of the intermediate space 21 increases. The compression force applied to the outer layer 11 is transmitted to the inner layer 12 through the intermediate space 21. Such force compresses the inner layer 12 to discharge the contents.

Next, when the compression force applied to the outer layer 11 is, as illustrated in FIG. 10(*f*), eliminated after the contents have been discharged, external air is introduced into the intermediate space 21 through the external air introduction hole 15 while the outer layer 11 restores the original shape by the restorative force of the outer layer 11 itself.

Lastly, the method for manufacturing the double container 1 having the above-described configuration will be described.

Figure 11:
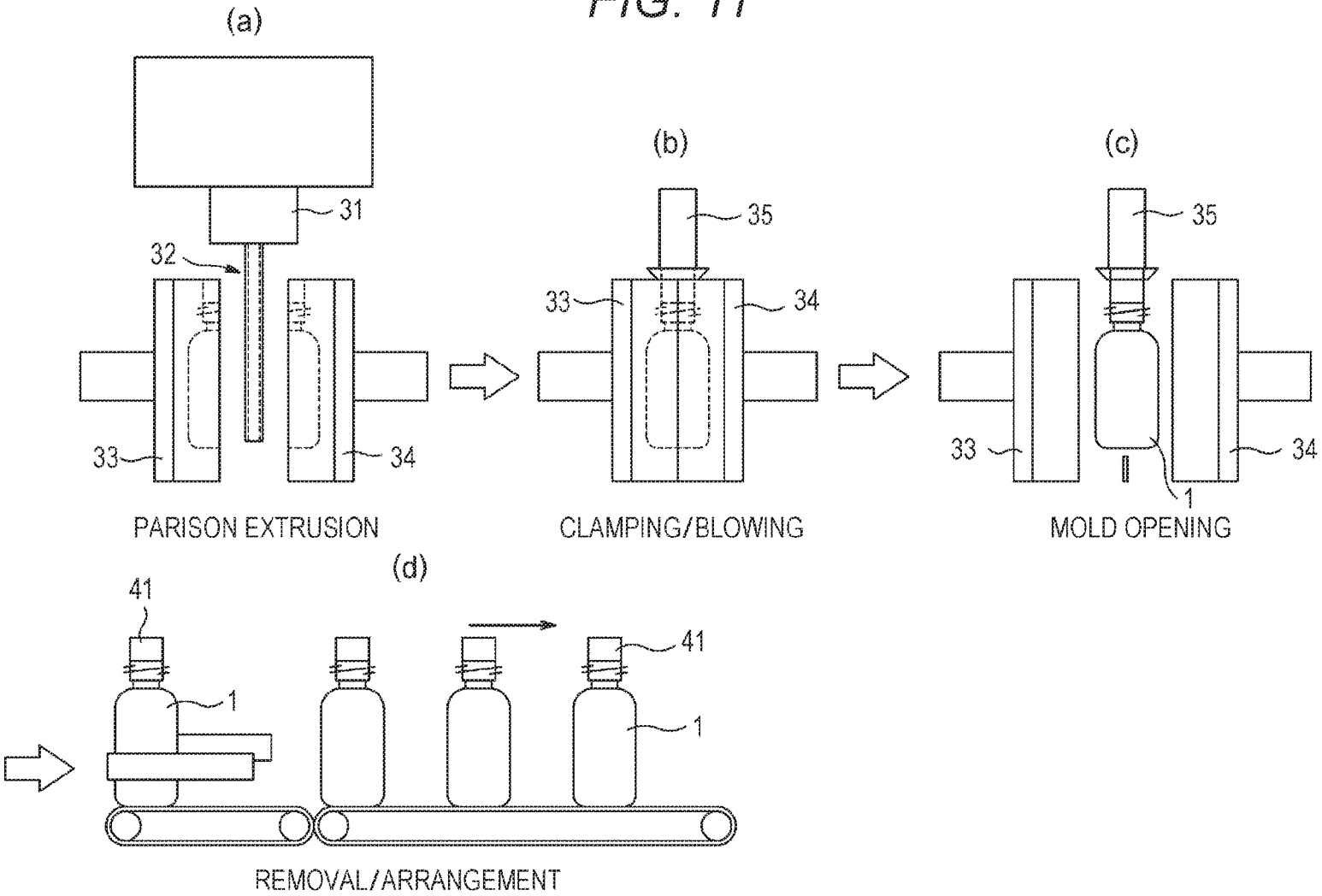
FIG. 11 is a view for illustrating double container molding steps.

For manufacturing the double container 1 as the delamination container, melted multilayer parison 31 having a multilayer structure corresponding to a double container 1 to be manufactured is first extruded from a die head 32 as illustrated in FIG. 11(*a*). This melted multilayer parison 31 is set in divided molds 33, 34 for blow molding, and then, the divided molds 33, 34 are closed.

Next, as illustrated in FIG. 11(*b*), a blow nozzle 35 is inserted into an opening of the double container 1 close to a port portion 4, and air is blown into a cavity of the divided molds 33, 34 in a clamped state.

Next, as illustrated in FIG. 11(*c*), the divided molds 33, 34 are opened, and a blow-molded article (the double container 1 as a delamination container) is taken out. The divided molds 33, 34 have cavity shapes forming a predetermined shape of each portion of the blow-molded article. Moreover, a pinch-off portion is provided on a lower side of bottom seal portions of the divided molds 33, 34, and therefore, lower burrs formed on the lower side of the bottom seal portions are removed. By the above-described steps, the double container 1 having an outer layer 11 and an inner layer 12 is formed (a container main body formation step).

Next, the double containers 1 are, after removal, arranged as illustrated in FIG. 11(*d*). At this stage, an upper cylindrical body 41 remains as a so-called burr at the port portion 4 of each double container 1 with the upper cylindrical body 41 extending from the port 4. Such a portion needs to be removed as an unnecessary portion by cutting.

Cutting of the upper cylindrical body 41 has been performed so far by cutting with a blade. However, it has been found that a phenomenon in which the inner layer 12 is delaminated from the outer layer 11 due to cutting occurs in a case where the opening 12 is thin. As a result of study conducted by the inventor(s) of the present invention, it has been found that such a phenomenon is especially noticeable in a case where the thickness of the inner layer 12 is equal to or less than 150 μm.

Figure 12:
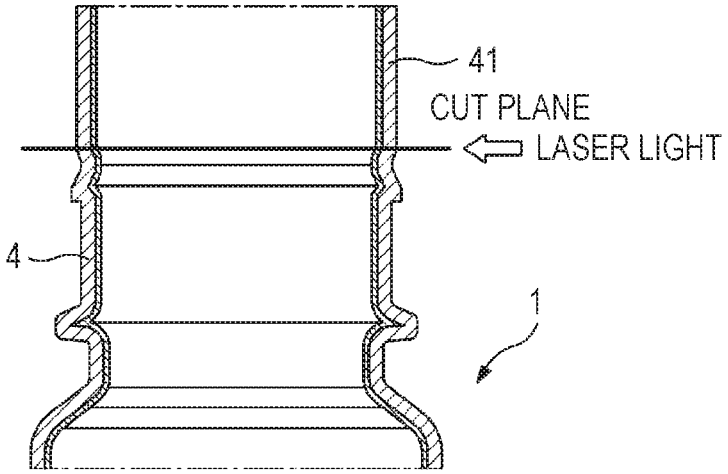
FIG. 12 is a view for illustrating the step of cutting and removing an unnecessary portion of the double container.

For this reason, here, cutting removal of the upper cylindrical body 41 is performed by cutting with a laser. As illustrated in FIG. 12, a cut target portion is irradiated with laser light L such that the laser light L is focused on the cut target portion, and in this manner, the resin upper cylindrical body 41 is cut and removed. Note that in the case of irradiation of the laser light L from one direction, the double container 1 is rotated or a light source of the laser light L is rotated around the double container 1 so that the upper cylindrical body 41 can be cut across the entire circumference thereof.

Any types of laser light may be used as long as such light can cut a resin multilayer body forming the double container 1. For example, gas laser of an excimer laser and the like, a solid-state laser, and a dye laser can be used. The laser light is preferably carbon dioxide laser and YAG laser, for example. A portion irradiated with these types of laser light is instantaneously heated to a high temperature, and therefore, the resin multilayer body is melted, evaporated, and cut.

In cutting with the laser, no physical force is applied to the inner layer 12. Thus, the inner layer 12 is not delaminated from the outer layer 11. Moreover, the inner layer 12 and the outer layer 11 are partially melted in the vicinity of the portion irradiated with the laser. As a result, the inner layer 12 and the outer layer 11 are in a pseudo-fusion state. This can prevent dislocation of the inner layer 12 at a tip end of the port portion 4. This is effective for attachment of a plugging cap, for example. Upon attachment of the plugging cap, the inner layer 12 is easily dislocated due to friction.

Figure 13:
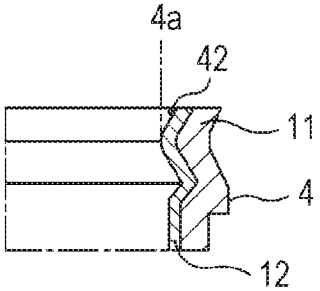
FIG. 13 is a schematic enlarged sectional view of a cut end portion.

Note that in cutting with the laser, a melted resin piece 42 called "resin dripping" might be, as illustrated in closeup in FIG. 13, formed at a cut position (the inner-diameter side of the port portion 4) after cutting. For example, in a case where the melted resin piece 42 is formed on the inside of the port portion 4 and contacts the inner ring of the cap, such contact might lead to a problem on attachment of the cap. Thus, by the design of the shape of the port portion 4 or proper laser irradiation conditions, the melted resin piece 42 is positioned on the outside with respect to an inner ring contact surface 4*a* of the port portion 4. Thus, the melted resin piece 42 does not contact the inner ring of the cap, and therefore, no problem on attachment of the cap having the inner ring is caused.

After the upper cylindrical body 41 has been cut and removed, an external air introduction hole 15 is perforated, and a hydrophobic filter F is bonded, for example. In this manner, manufacturing of the double container 1 is completed.

The embodiments to which the present invention is applied have been described above. However, the present invention is not limited to these embodiments. Needless to say, various changes can be made to these embodiments without departing from the gist of the present invention.

The invention claimed is:

1. A double container comprising:
an outer layer as an outer shell; and
an inner layer as an inner bag, wherein
the inner bag contracts in association with a decrease in a content housed in the inner bag,
the outer layer is provided with a recessed portion and the recessed portion is provided with an atmospheric air introduction hole, and
a hydrophobic filter configured to allow air penetration and block water is provided to close the atmospheric air introduction hole.

2. The double container according to claim 1, wherein
the hydrophobic filter is formed of non-woven fabric made of polypropylene.

3. The double container according to claim 2, wherein
a weight of the polypropylene non-woven fabric per unit area is 160 $g/m^2$ to 250 $g/m^2$.

4. The double container according to claim 1, wherein
the hydrophobic filter includes hydrophobic microporous membrane and non-woven fabric, the microporous membrane and the non-woven fabric being stacked on each other.

5. The double container according to claim 1, wherein
the atmospheric air introduction hole is provided with a valve member, the valve member being configured to adjust air outflow/inflow between an external space and an intermediate space formed between the outer layer and the inner layer.

6. The double container according to claim 5, wherein the recessed portion comprises an upper stage and a lower stage provided with the atmospheric air introduction hole, the valve member is attached to the lower stage and the hydrophobic filter is bonded to the upper stage.

* * * * *